United States Patent [19]

Torelli et al.

[11] Patent Number: 4,696,035

[45] Date of Patent: Sep. 22, 1987

[54] SYSTEM FOR EXPANDING THE STEREO BASE OF STEREOPHONIC ACOUSTIC DIFFUSION APPARATUS

[75] Inventors: Guido Torelli, S. Alessio; Alejandro De La Plaza, Bergamo, both of Italy

[73] Assignee: SGS Microelectronica S.p.A., Catania, Italy

[21] Appl. No.: 889,921

[22] Filed: Jul. 28, 1986

[30] Foreign Application Priority Data

Aug. 9, 1985 [IT] Italy ..... 21898 A/85

[51] Int. Cl.[4] ..... H04R 5/00

[52] U.S. Cl. ..... 381/1

[58] Field of Search ..... 381/1, 2, 17, 18, 96, 381/98, 106; 369/86, 87, 88

[56] References Cited

U.S. PATENT DOCUMENTS 4,442,546 4/1984 Ishigari ..... 381/106

4,498,060 2/1985 Dolby ..... 381/106

*Primary Examiner*—Forester W. Isen

*Attorney, Agent, or Firm*—Wenderoth, Lind & Ponack

[57] ABSTRACT

A first and a second input signal, constituting a stereophonic pair are amplified in respective direct amplifier means so as to obtain a first and a second output signal. In order to obtain the expansion of the stereo base, said output signals are added by adder means in a desired phase relationship, chosen between phase coincidence and phase opposition, and the sum signal thus produced is processed by a feedback block having a desired transfer function, and is then superimposed on the first input signal with opposite phase, and is superimposed on said second input signal with opposite or equal phase, according to whether said output signals are added respectively in phase coincidence of phase opposition. The feedback block preferably includes a band pass filter, and its gain is externally programmable.

8 Claims, 3 Drawing Figures

SYSTEM FOR EXPANDING THE STEREO BASE OF STEREOPHONIC ACOUSTIC DIFFUSION APPARATUS

BACKGROUND OF THE INVENTION

1. Field of the Invention

This invention is concerned with a system for expanding the stereo base of acoustic stereophonic diffusion apparatus.

When the distance between the two loudspeakers of an acoustic stereophonic diffusion apparatus is relatively small (e.g. 60–70 cm.) the stereophonic effect is almost imperceptible, or anyway inadequate, for listeners positioned some distance away from the loudspeakers. In order to simulate the effect that would be obtained with speakers set farther apart, it is known to process the acoustic input signals of the system, to enhance their stereophonic characteristics, thus performing the so-called "expansion of the stereo base".

The conventional method for achieving said aim is to use a "recursive" technique, in which a crosstalk in phase opposition is created between the two acoustic channels (left and right), usually by subtracting the output signal of each channel from the input signal of the other channel, with a suitable amplification or attenuation of said subtracted signals. In practice such crosstalk is performed only on a part of the total band of the signal, in order to avoid problems related to the propagation of acoustic waves and to the physiology of listening, which are known to persons skilled in the art.

Therefore the crossing paths of the signals being fed back to the input include band pass filters, and correction filters are often included in the two direct channels as well. Both the two direct channels and the crosstalk paths can therefore be regarded as filters (active or passive), and when, in the following disclosure reference is made to amplifiers, everywhere it should be understood that the amplification provided may incorporate a desired filtering as well.

Systems of the above mentioned kind are described, e.g., in "DIGIT 2000—VLSI Digital TV System", ITT Semiconductors, Publication Order No. 6251-190-2E, page 1.13, August 1982, or in "The German Systems and Integrated Circuits for 'High-Quality' TV Receivers", by U. Buhse, in *IEEE Transactions on Consumer Electronics,* Vol. CE-28, No. 4, page 489, November 1982. Such known solutions require four amplifier (and/or filtering) blocks, i.e. two for the direct channels (i.e. for driving the downstream stages of the system), and the other two for the signals being fed back to provide the expansion. The complexity of such blocks depends on the complexity of the filtering functions which it is desired to obtain. Furthermore, is it desired to make the degree of expansion programmable, the technique is critical because it requires the parallel adjustment of the gain and/or the filtering in two different blocks in an identical degree.

SUMMARY OF THE INVENTION

The object of the invention is to provide a system for expanding the stereo base in stereophonic signals, for stereophonic acoustic diffusion apparatus, of the recursive type, which is circuitally simpler than the known ones, and in particular requires only one amplifier and filtering block on the feedback path, so that it is less expensive to the implemented within an integrated circuit, and requires only one adjustment of parameters to vary the expansion thus obtained.

The invention achieves this object, together with other aims and advantages, which will better appear hereinafter, with a system for expanding the stereo base for stereophonic acoustic diffusion apparatus, in which a first and a second input signal, constituting a stereophonic pair, are amplified in respective direct amplifier means to obtain a first and a second output signal, characterized in that, in order to obtain the expansion of the stereo base, said output signals are added by adder means, in a desired phase relationship, chosen between phase coincidence and phase opposition, and the sum signal thus produced is processed by a feedback block having a desired transfer function, and is then superimposed on said first input signal, with opposite phase, and is superimposed on said second input signal in phase opposition or phase coincidence therewith, depending on whether said output signals are added respectively in phase coincidence or phase opposition.

BRIEF DESCRIPTION OF THE DRAWINGS

A preferred embodiment of the invention will now be described, given by way of non-limitative example, with reference to the accompanying drawings, where.

DETAILED DESCRIPTION OF THE PREFERRED EMBODIMENTS

The invention is based on the observation that the stereophonic information of an acoustic signal is entirely contained in the differential part of the signals of the two channels, whereas their common part only contains monaural information. For instance, in the case of a monophonic audio signal (such as the voice of a speaker placed at the center of the transmission stand), the lefthand signal $V_L$ and the righthand signal $V_R$ are both identical to one same value $V_i$:

$$V_L = V_i$$

$$V_R = V_i,$$

while, in the case of a maximally stereophonic audio signal (such as the sound of an instrument located at one end of the stand) the two signals will be ideally:

$$V_L = V_i$$

$$V_R = 0,$$

that is to say $$V_L = V_i/2 + V_i/2 \quad (1a)$$

$$V_R = V_i/2 - V_i/2 \quad (1b)$$

From the equations (1), it follows that a signal with maximum stereophonic content comprises a first common component, equal in amplitude and phase in both channels, and a second, differential, part, equal in amplitude to the former but with opposite phase in the two channels. Expanding the stereo base of the stereophonic signal, is therefore equivalent to enhancing the differential part with respect to the common part.

Figure 1:
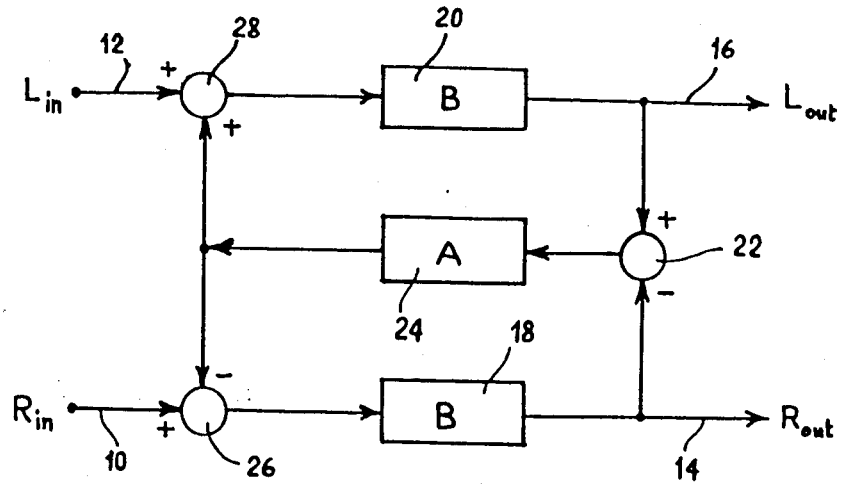
FIG. 1 is a block diagram of a first embodiment of a system for expanding the stereo base, according to the invention.

This concept has been implemented in a first embodiment of a recursive system for expanding the stereo base, according to the invention, shown in FIG. 1. The system comprises respective inputs 10 and 12 of the right-hand and left-hand input signals $R_{in}$ and $L_{in}$, constituting a stereophonic pair, and respective outputs 14 and 16 for the right-hand and left-hand output signals $R_{out}$ and $L_{out}$. In the right and left channels defined respectively between the right and left inputs and outputs, respective right and left amplifiers 18 and 20 are connected, identical to each other, each having a gain B at the center of the band. As specified above, amplifiers 18 and 20 can include filtering functions, for example of the low-pass type, for attenuating the treble tones.

Output signals $R_{out}$ and $L_{out}$ are applied to linear-combination means 22 adapted to provide the difference between said output signals, and said difference is applied to a feedback amplifier 24, which includes a band-pass filter, and which has a gain A at the center of the band. Since the amplitude of the gain A of the block 24 may be less than 1 (depending on the design parameters of the entire system), the term "amplifier" in this context is to be understood as referring to a generic transfer block, possibly reduced to a simple passive filtering network.

The output signal of amplifier 24 is applied, on one side, to subtracting means 26 placed in cascade, in the right channel at the input of amplifier 18, so as to be subtracted (i.e., added in opposite phase) to the right input signal $R_{in}$; on the other side, it is applied to adder means 28 placed in cascade in the left channel at the input of amplifier 20, so as to be added (in phase) to the left input signal $L_{in}$.

When the relations imposed by the system of FIG. 1 between the input and output signals are expressed in mathematical terms, the following equations are finally obtained, where the symbols have the meanings described above:

$$(1-2AB)L_{out}=B(1-AB)L_{in}-AB^2R_{in} \quad (2a)$$

$$(1-2AB)R_{out}=B(1-AB)R_{in}-AB^2L_{in} \quad (2b)$$

If, in view of what has been set forth with reference to equations (1), the signals $R_{in}$ and $L_{in}$ are expressed as follows:

$$L_{in}=C+D$$

$$R_{in}=C-D$$

where C is the common part and D is the differential part of the two signals, equations (2) can be written as follows:

$$L_{out}=BC+DB/(1-2AB) \quad (3a)$$

$$R_{out}=BC-DB/(1-2AB) \quad (3b)$$

Since A and B, at least at the center of the band, have the same sign, for appropriate values of A and B (i.e. when AB ($\frac{1}{2}$), the differential part D is amplified more than the common part, thus causing the desired expansion of the stereo base.

Preferably, in the practical implementation the value of the gain A of block 24 is programmable, so as to enable the same circuit to be used in different applications, in which different expansions are required. This does not prevent the possiblity of making the gains of blocks 18, 20 programmable as well.

Figure 2:
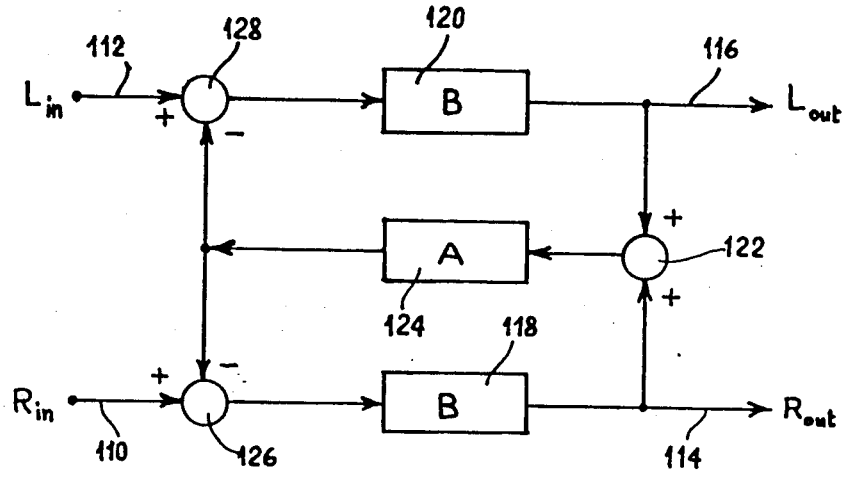
FIG. 2 is a block diagram of a second embodiment of a system for expanding the stereo base according to the invention.

The embodiment of the invention illustrated in FIG. 2, largely similar to the one of FIG. 1, bears the same reference numbers of the corresponding parts, increased by 100.

The second embodiment is different from the first in that the subtracting means 22 are replaced by adder means 122, and the adder means 28 on the left channel $L_{in}$ are replaced by subtracting means 128. All the other elements are substantially identical to the corresponding ones in FIG. 1, and the same remarks hold for the amplification and the filtering functions.

By writing the equations binding the output signals to the differential and common parts of the input signals, the following is obtained in this case:

$$L_{out}=CB/(1+2AB)+DB \quad (4a)$$

$$R_{out}=CB/(1+2AB)+DB \quad (4b)$$

Also in this case, since A and B (at the center of the band) have the same sign, the amplification for the differential part is greater than for the common part, and therefore the stereo base is expanded. Also in this case, the expansion can be made programmable in a particularly effective manner, by programming the gain of the feedback block 124.

Figure 3:
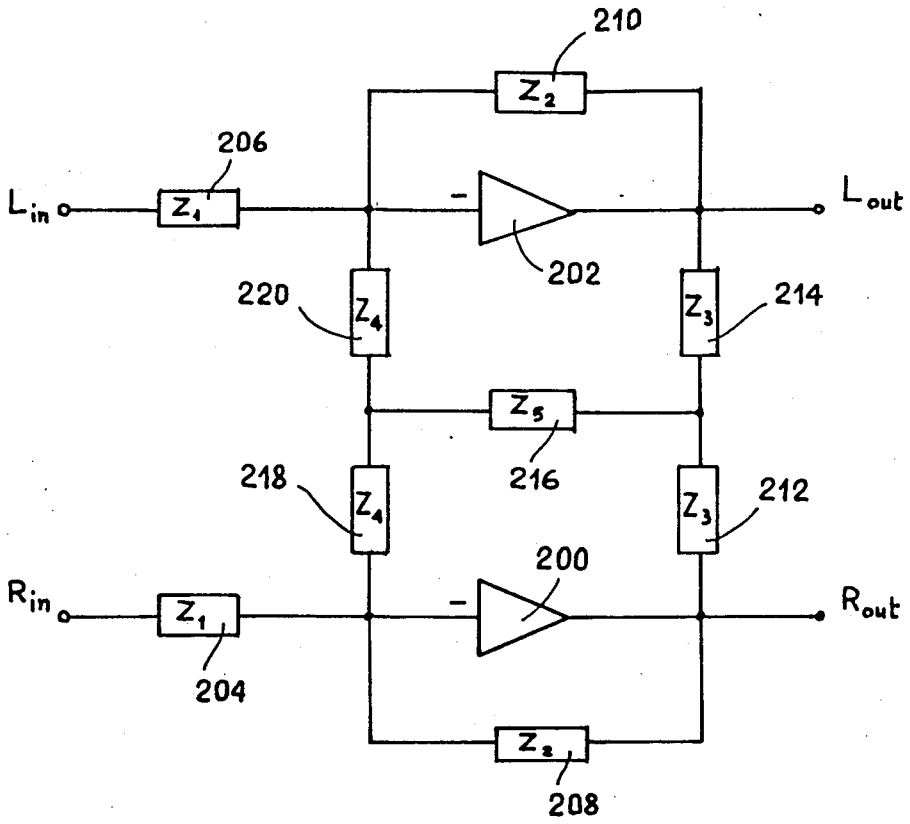
FIG. 3 is a circuit diagram of a practical implementation of the embodiment of FIG. 2, particularly suitable for being built-in in an integrated circuit.

With reference to FIG. 3, a practical implementation of the invention comprises two operational amplifiers 200, 202, to the inverting inputs of which the respective signals $R_{in}$ and $L_{in}$ are applied through respective input impedances 204, 206 having an identical value $Z_1$. To each of the operational amplifiers 200, 202 are coupled in parallel respective impedances 208, 210, having an identical value $Z_2$.

The outputs of the operational amplifiers 200, 202 are connected to each other by two series impedances 212, 214, having an equal value $Z_3$, the central node of which is connected, through a further impedance 216 having a value $Z_5$, to the central node of two other series impedances 218, 220, these also having identical value $Z_4$, which connect to each other the inputs of the operational amplifiers.

In the implementation of FIG. 3, which is particularly suitable for being built-in in an integrated circuit, the functions of the blocks 118, 120 of FIG. 2 have been assigned respectively to the groups 200, 204, 208, on one side, and 202, 206, 210 on the other. In each case the gain equivalent to the case of FIG. 2 turns out to be:

$$B=-Z_2/Z_1.$$

The symmetrical network comprising the impedances 212, 214, 216, 218, 220 is equivalent to the feedback block 124 together with the adder means 122, and the equivalent transfer function is:

$$A=-(Z_1/4)/(Z_3/2+Z_4/2+Z_5).$$

Each of the values $Z_1 \ldots Z_5$ will generally be a desired complex function, e.g. a capacity, a resistance, a capacity and a resistance in parallel, or other more intricate combinations, so as to supply the desired transfer functions A and B necessary to obtain the desired filtering, according to design procedures known to persons skilled in the art.

The impedance 216 can be provided externally to the integrated circuit, and in this case it preferably comprises a variable, or in any case replaceable, resistor, in order to program the degree of expansion. If such programmability is not required, the impedance 216 can be a mere short-circuit, since its purpose can be fulfilled by the four adjacent impedances 212, 214, 218, 220.

If the circuit of FIG. 3 is provided in an MOS integrated circuit, in which it is relatively easy to obtain capacitors having values in an accurately defined relationship, while it is difficult to obtain resistors having an acceptable accuracy, all the resistors composing the impedances 204 . . . 220 are preferably simulated with the switched capacitor technique, known in the art.

In both of the embodiments described, it should be noted that, if the so-called "full differential" technique is employed, which always makes available both the non-inverted signals and the inverted ones, the practical implementation is particularly easy, because obtaining either the sum and the difference of the two signals is equally immediate.

The preferred embodiments of the invention, described above, are capable of the equivalent modifications and variations, within the scope of the given teachings, without departing from the scope of the invention.

We claim:

1. A system for expanding the stereo base for stereophonic acoustic diffusion apparatus, in which a first and a second input signal, constituting a stereophonic pair, are amplified in respective direct amplifier means, in order to obtain a first and a second output signal, wherein, in order to expand the stereo base, said output signals are added by adder means in a predetermined phase relationship, chosen between phase coincidence and phase opposition, and the sum signal thus produced is processed by a feedback block having a predetermined transfer function, and is then superimposed on the first input signal with opposite phase, and is superimposed on said second input signal in phase opposition or phase coincidence, depending on whether said output signals are added respectively in phase coincidence or phase opposition.

2. A system for expanding the stereo base according to claim 1, wherein said feedback block includes a bandpass filter.

3. A system for expanding the stereo base according to claim 1, wherein said direct amplifier means include respective low-pass filters.

4. A system for expanding the stereo base according to claim 1, wherein the transfer function at a center of the band of said feedback block is programmable.

5. A system for expanding the stereo base according to claim 1, which is implemented according to the full differential technique.

6. A system for expanding the stereo base according to claim 1, wherein each of said amplifier means of said first and second input signal is an inverting operational amplifier, having a first series impedance on its input and a second impedance connecting its output with its input.

7. A system for expanding the stereo base according to claim 6, wherein said adder means and said feedback block consist of an H-like symmetrical network of impedances, two external ends of said H-like network being connected to the respective outputs of said operational amplifiers, the other two ends of the H-like network being connected to the respective inputs of said operational amplifiers.

8. A system for expanding the stereo base according to claim 7, wherein a value of the impedance in a common section of said H-like network is substantially equal to zero.

* * * * *